US007827885B2

(12) United States Patent
Rowell

(10) Patent No.: US 7,827,885 B2
(45) Date of Patent: Nov. 9, 2010

(54) DRIVE EXTENSION WRENCH

(76) Inventor: Jerry Rowell, 7713 Aspen Dr., Pittsburgh, PA (US) 15239

( * ) Notice: Subject to any disclaimer, the term of this patent is extended or adjusted under 35 U.S.C. 154(b) by 0 days.

(21) Appl. No.: 12/077,965

(22) Filed: Mar. 24, 2008

(65) Prior Publication Data

US 2008/0229886 A1 Sep. 25, 2008

Related U.S. Application Data

(60) Provisional application No. 60/896,708, filed on Mar. 23, 2007.

(51) Int. Cl.
*B25B 17/00* (2006.01)

(52) U.S. Cl. ..... 81/57.3

(58) Field of Classification Search ..... 81/57.3, 81/57.14; 74/421 R, 413, 431–433
See application file for complete search history.

(56) References Cited

U.S. PATENT DOCUMENTS 1,042,736 A * 10/1912 Wildmo ..... 81/57.3
1,346,505 A * 7/1920 Mitchell ..... 81/57.3
1,378,719 A * 5/1921 Poole ..... 81/57.3
2,830,479 A * 4/1958 Finn ..... 81/57.3
3,987,691 A * 10/1976 Savage ..... 81/57.3
4,063,475 A * 12/1977 Perkins ..... 81/57.22
4,374,479 A * 2/1983 Minotti ..... 81/57.3
4,374,480 A * 2/1983 Diaz ..... 81/57.3
4,735,118 A * 4/1988 Broemel, Jr. ..... 81/57.3
4,825,729 A * 5/1989 Puncochar ..... 81/57.3
D313,731 S * 1/1991 Crawford ..... D8/25
5,458,603 A * 10/1995 Futch, Sr. ..... 606/104
5,732,605 A * 3/1998 Mann ..... 81/57.3
6,647,830 B2 11/2003 Marquardt
6,832,531 B1 12/2004 Marquardt
6,923,094 B1 8/2005 Marquardt
6,945,139 B1 * 9/2005 Johnson ..... 81/57.3

* cited by examiner

*Primary Examiner*—David B Thomas
(74) *Attorney, Agent, or Firm*—James Ray & Assoc

(57) ABSTRACT

An driver extension wrench having a pair of elongate housing members with openings at opposing ends of the housing members, with a plurality of interior posts at a predetermine spacing. The openings have sockets with exterior gear teeth. Gears are mounted on each of the posts and cooperate with each other and the sockets so that rotational force applied to the first opening is transmitted through the gears to the second opening to be applied to a fastener.

15 Claims, 3 Drawing Sheets

DRIVE EXTENSION WRENCH

CROSS REFERENCE TO RELATED APPLICATION

This patent application is related to and claims priority from U.S. Provisional Patent Application Ser. No. 60/896,708 filed Mar. 23, 2007.

FIELD OF THE INVENTION

The present invention relates, in general, to extension wrenches and, more particularly, this invention relates to power driven extension wrenches.

BACKGROUND OF THE INVENTION

Prior to the conception and development of the present invention, as is generally well known in the prior art, extension wrenches with a flexible drive such as a chain.

SUMMARY OF THE INVENTION

The present invention provides a pair of elongate housing members with openings at opposing ends. The interior one of the housing members has a plurality of posts attached and spaced at a predetermined distance. Gears are mounted on each of the posts. In the presently preferred embodiment, the gears are star gears. The first opening has a generally circular member with circumferential gear teeth. The circular member is rotatably mounted within the housing members. A second generally circular member having circumferential gear teeth is rotatably mounted within the second opening. The first generally circular member, the plurality of gears and second generally circular member cooperate. Thus, rotational force applied to the first circular member is transmitted through the plurality of gears to the second circular member.

OBJECTS OF THE INVENTION

It is, therefore, one of the primary objects of the present invention to provide an extension wrench to drive fasteners and nuts at a distance.

Another object of the present invention is to provide a drive extension wrench with rigid members not subject to requiring adjustment with wear.

Still another object of the present invention is to provide an extension wrench that provides an assembly that is easily disassembled for maintenance.

Yet another object of the present invention is to provide an extension wrench that can be driven manually or by a power drill.

An additional object of the present invention is to provide an extension wrench with a socket driver to receive a plurality of sockets.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
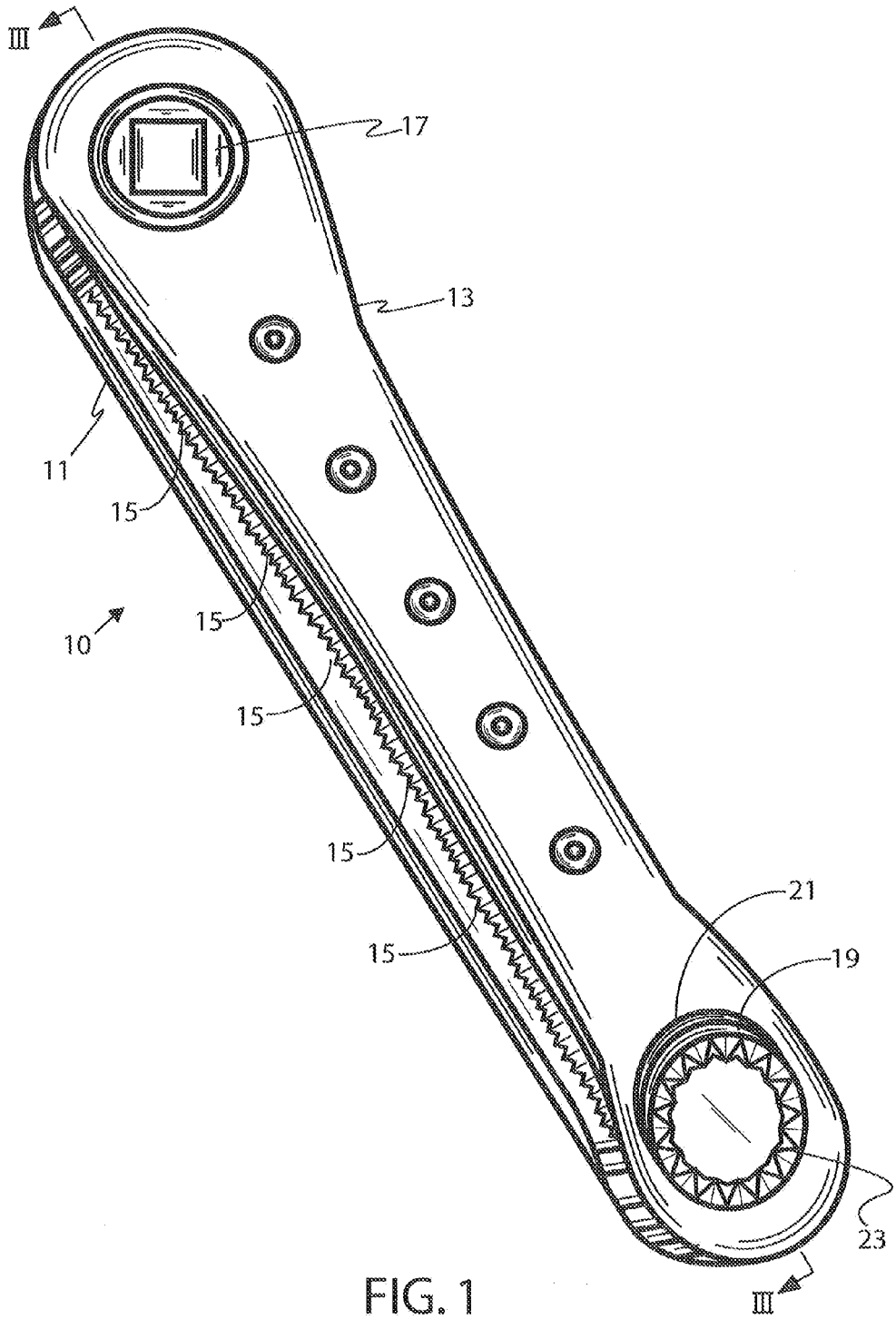
FIG. 1 is a perspective view of the extension wrench.
Figure 2:
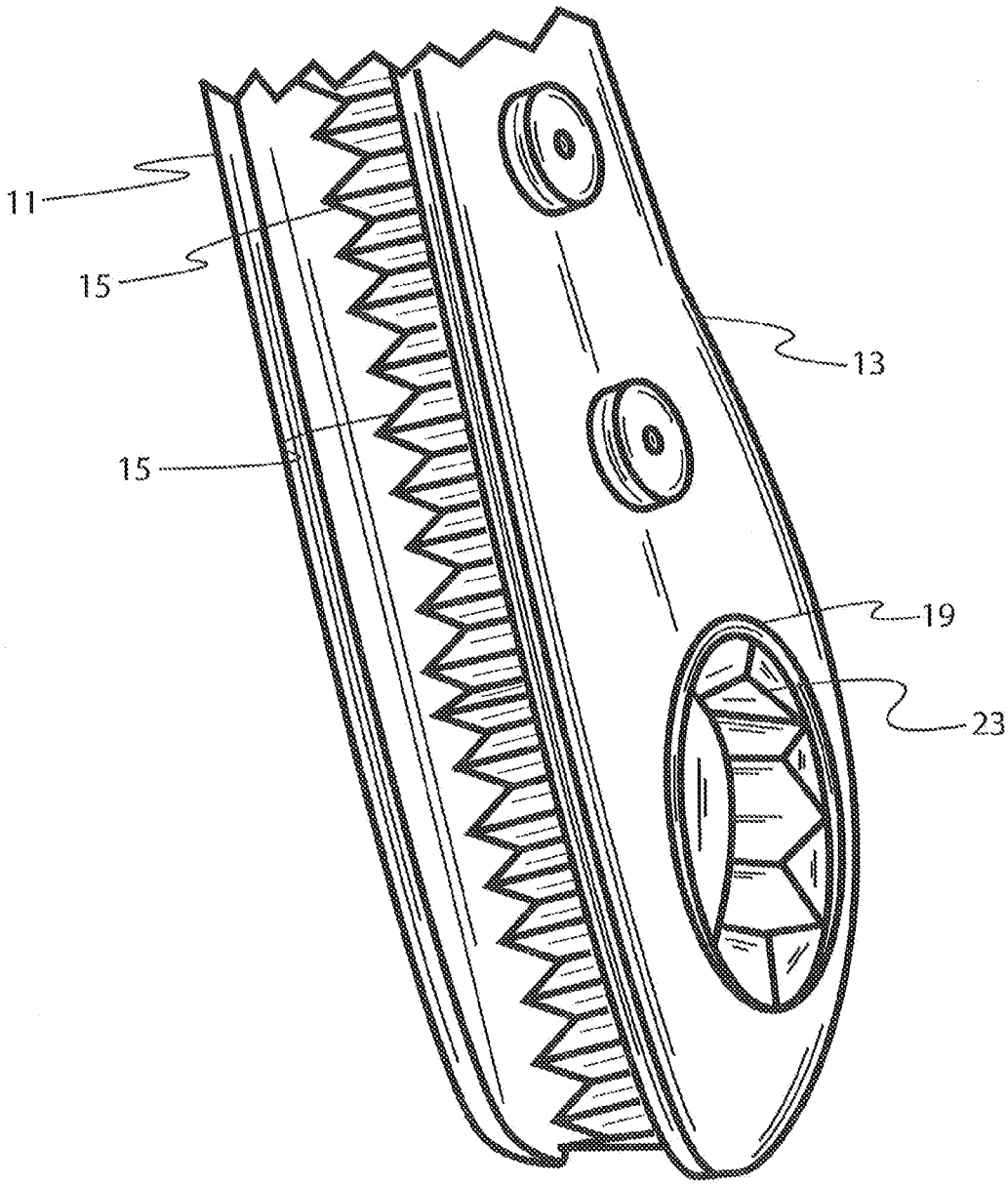
FIG. 2 is a partial perspective view of the extension wrench.
Figure 3:
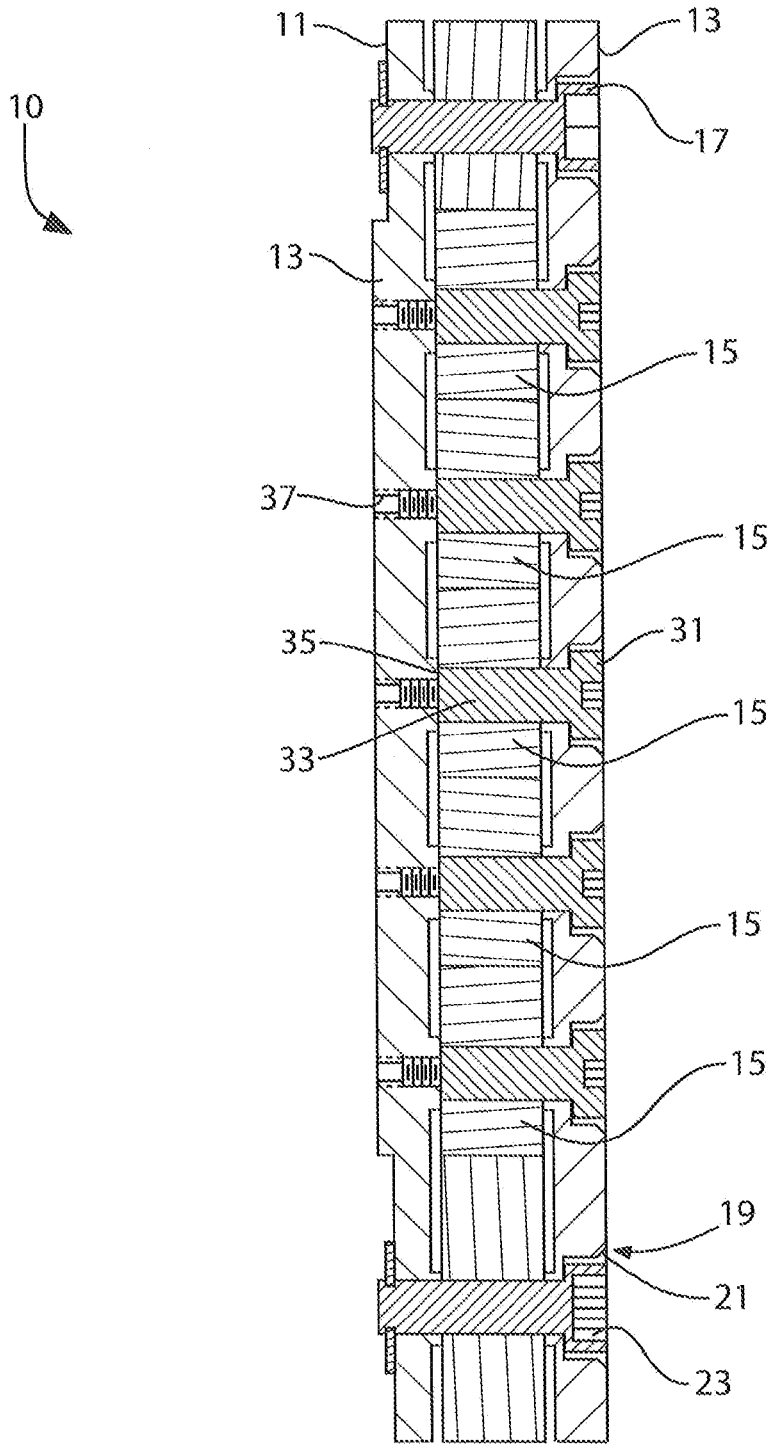
FIG. 3 is a side cross sectional view

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to FIG. 1. The extension wrench generally referred to as 10 having to elongate housing members 11 and 13. The elongate housing members 11 and 13 have generally circular openings within the housing members 11 and 13. A plurality of cylindrical posts (not shown) fixably attached to housing member 11.

The posts are positioned at predetermined locations and have a predetermined height and width. Gears 15 are rotatably mounted on each of the posts so that the gears 15 cooperate. In the preferred embodiment the gears are star gears without limiting the use of other types of gears. The gears 15 in the preferred embodiment are manufactured of carbon steel or nylon.

The generally first circular member 17 is rotatably mounted within the first opening in housing members 11 and 13 where the first circular member having exterior surface circumferential gear teeth. The gear teeth cooperate with the gear 15 proximate to first opening of the wrench. In the preferred embodiment, the first circular member 17 has a width greater than the width of the assembled housing members 11 and 13. The first circular member has top and bottom lips 19 greater than the diameter of the first opening. The housing members 11 and 13 have a slightly tapered edge 21 rotatably holding the first circular member 17 so that first circular member 17 has generally the same profile at the housing members 11 and 13.

The first circular member has an interior cavity with a predetermined shape. In the preferred embodiment the predetermined shape receives the driving bit of a power drill.

Similarly, a second circular member 23 has is rotatably mounted within the first opening in housing members 11 and 13 where the second circular member has exterior surface circumferential gear teeth. The gear teeth cooperate with the gears 15 proximate the second circular member 23. In the preferred embodiment, the second circular member 23 has a width greater than the width of the assembled housing members 11 and 13. The first circular member has top and bottom lips 19 greater than the diameter of the first opening. The housing members 11 and 13 have a slightly tapered edge 21 rotatably holding the second circular member 23 so that the second circular member 23 has generally the same profile at the housing members 11 and 13.

The second circular member 23 has an interior cavity with a predetermined shape. In the preferred embodiment the predetermined shape receives the head of a fastener, bolt or a nut.

In another embodiment, the second circular member is solid with at least one conventional square driver attached to at least one side of the second circular member 23. In this embodiment, the second circular member could receive a plurality of sizes of sockets or extenders.

Rotational force is applied to the first circular member 17 and transmitted through the gears 15 to the second circular member 23 to tighten and loosen fasteners and nuts. The rotational force may be applied manually or with a power tool such as a drill.

The housing members are assembled and connected so that the housing members 11 and 13 are aligned. In the preferred embodiment the housing members 13 has apertures in a corresponding position to each of the posts. In the preferred embodiment, the posts are bosses 35 and are internally threaded 37. The housing members are connected by bolts 33 or machine screws.

In a second embodiment, the posts are hollow and the first housing member has apertures corresponding to the position to each of the posts. A bolt is inserted through each of the apertures and snugged with a nut on the opposing surface.

In a third embodiment, housing member 11 has a circumferential lip slightly larger than the circumferential exterior surface of housing member 13. The housing members form a snap fit aligning and connecting the housing members.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. An extension wrench having an elongate pair of housing members with openings at opposing ends comprising:

a connecting means aligning and connecting said pair of housing members in a generally parallel relationship;

a plurality generally cylindrical posts, with predetermined height and spacing, fixably attached to one of such housing members at a substantially right angle to such housing member;

said connecting means at a predetermined location corresponding said cylindrical posts;

a plurality of gears rotatably mounted on each of said posts;

a generally circular member rotatably attached to a first opening having circumferential gear teeth cooperating with said gears, a first socket having an interior predetermined shape to receive a driver bit; and a second generally circular member rotatably attached to a second opening having circumferential gear teeth cooperating with said gears, a second socket having a predetermined shape, power applied to said first socket is transmitted through said gears to said second socket to rotate said second socket.

2. An extension wrench according to claim 1 wherein said posts are hollow said first housing has apertures through such first housing, such second housing as apertures corresponding to said posts and said connecting means is a threaded bolt and nut connecting such housing members.

3. An extension wrench according to claim 1 wherein said posts are hollow threaded bosses, such second housing has apertures corresponding to said bosses and said connecting means is one of a threaded bolt and machine screw.

4. An extension wrench according to claim 1 wherein said first circular member is a socket with an interior predetermined shape to accommodate a driver bit of a powered hand drill.

5. An extension wrench according to claim 1 wherein said second generally circular member has an interior portion that is a cavity with a predetermined shape to accommodate a fastener or nut.

6. An extension wrench according to claim 1 wherein said second circular member has an interior portion that has a square driver attached to said interior portion of said second generally circular to releasably receive a socket.

7. An extension wrench according to claim 1 wherein said second socket releasably receives a socket extension driver.

8. An extension wrench according to claim 1 wherein said gears are star gears.

9. An extension wrench according to claim 1 wherein said gears are manufactured from one of carbon steel and nylon.

10. An extension wrench having an elongate pair of housing members with openings at opposing ends comprising:

a plurality generally cylindrical bosses, with predetermined height and spacing, at a substantially right angle to such housing members attached to at least one of such housing members;

a plurality of star gears rotatably mounted on each of said posts;

a generally circular member rotatably attached to a first opening having circumferential gear teeth cooperating with said gears, a first socket having an interior predetermined shape to receive a driver bit;

a second generally circular member rotatably attached to a second opening having circumferential gear teeth cooperating with said gears, a second socket having a predetermined shape, wherein power applied to said first socket is transmitted through said gears to said second socket to rotate said second socket;

a plurality of apertures in such other housing member corresponding to each of said bosses; and a fastener for each of said bosses one of bolt or machine screw, aligning and connecting such housing members.

11. An extension wrench according to claim 10 wherein said gears are manufactured of one of carbon steel and nylon.

12. An extension wrench according to claim 10 wherein said first circular member is a socket with an interior predetermined shape to accommodate a driver bit of a powered hand drill.

13. An extension wrench according to claim 10 wherein said second generally circular member has an interior portion that is a cavity with a predetermined shape to accommodate a fastener or nut.

14. An extension wrench according to claim 10 wherein said second circular member has an interior portion that has a square driver attached to said interior portion of said second generally circular to releasably receive a socket.

15. An extension wrench according to claim 10 wherein said second socket releasably receives a socket extension driver.

* * * * *